US011459147B2

(12) United States Patent
Futral et al.

(10) Patent No.: US 11,459,147 B2
(45) Date of Patent: Oct. 4, 2022

(54) GRIP CONTAINER SYSTEM

(71) Applicant: RING CONTAINER TECHNOLOGIES, LLC, Oakland, TN (US)

(72) Inventors: Daniel M. Futral, Somerville, TN (US); Theodore Guss, Crystal Lake, IL (US); Paul Vincent Kelley, Arlington, TN (US)

(73) Assignee: RING CONTAINER TECHNOLOGIES, LLC, Oakland, TN (US)

( * ) Notice: Subject to any disclaimer, the term of this patent is extended or adjusted under 35 U.S.C. 154(b) by 466 days.

(21) Appl. No.: 16/185,590

(22) Filed: Nov. 9, 2018

(65) Prior Publication Data

US 2020/0148419 A1 May 14, 2020

(51) Int. Cl.
*B65D 23/10* (2006.01)
*B65D 1/02* (2006.01)

(52) U.S. Cl.
CPC ..... *B65D 23/102* (2013.01); *B65D 1/0215* (2013.01); *B65D 1/0246* (2013.01); *B65D 2501/0027* (2013.01); *B65D 2501/0081* (2013.01)

(58) Field of Classification Search
CPC .. B65D 23/102; B65D 1/0215; B65D 1/0246; B65D 2501/0027; B65D 2501/0081
See application file for complete search history.

(56) References Cited

U.S. PATENT DOCUMENTS 6,527,133 B1 * 3/2003 McCollum ..... B65D 1/0223 220/660
2017/0021956 A1 * 1/2017 Ring ..... B65D 1/0223
2019/0359369 A1 * 11/2019 Benko ..... B32B 3/266

* cited by examiner

*Primary Examiner* — Anthony D Stashick
*Assistant Examiner* — L Kmet
(74) *Attorney, Agent, or Firm* — Sorell, Lenna & Schmidt, LLP

(57) ABSTRACT

A food packaging container is provided. The container comprises a molded body defining a longitudinal axis, and including a plurality of sides and a plurality of axial corners. Each corner has a recess including a first portion and a second portion. Each of the first portions includes an axial grip surface where the grip surfaces are aligned with the body in an orientation for gripping. In some embodiments, packaging products, containers, handles, tooling, applicators and methods are disclosed.

20 Claims, 6 Drawing Sheets

GRIP CONTAINER SYSTEM

TECHNICAL FIELD

The present invention generally relates to a container and more particularly to a container having grip surfaces for easy handling.

BACKGROUND

Plastic blow-molded containers are commonly used for food and/or beverage packaging products. Many food and beverage products are sold to the consuming public in blow-molded containers. These containers can be made from polyethylene terephthalate or other suitable plastic resins in a range of sizes. The empty blow-molded containers can be filled with food and/or beverage products at a fill site utilizing automated fill equipment.

For example, manufacture of such plastic blow-molded containers can include initially forming plastic resin into a preform, which may be provided by injection molding. Typically, the preform includes a mouth and a generally tubular body that terminates in a closed end. Prior to being formed into containers, preforms are softened and transferred into a mold cavity configured in the shape of a selected container. In the mold cavity, the preforms are blow-molded or stretch blow-molded and expanded into the selected container.

These food packaging containers are adapted to store such products, however, can be difficult in handling, for example, to carry and dispense the food, food preparation and/or beverage products. Further, the material that the containers are made from may not maintain and/or extend the shelf life of the stored products disposed within the containers. This disclosure describes an improvement over these prior technologies.

SUMMARY

In one embodiment, a food packaging container is provided. The container comprises a molded body defining a longitudinal axis, and includes a plurality of sides and a plurality of axial corners. Each corner has a recess including a first portion and a second portion. Each of the first portions includes an axial grip surface where the grip surfaces are aligned with the body in an orientation for gripping. In some embodiments, packaging products, containers, handles, tooling, applicators and methods are disclosed.

In one embodiment, the food packaging container comprises a molded body defining a longitudinal axis and includes a first side and a second side. At least one of the sides includes a first axial corner and a second axial corner. Each corner has a recess including a first portion and a second portion, and each of the first portions includes an axial grip surface having a linear configuration. The grip surfaces are aligned with the body in an orientation for gripping.

In one embodiment, the food packaging container comprises a molded body defining a longitudinal axis, and includes a plurality of sides and a plurality of axial corners. Each corner having a recess including a first portion and a second portion. Each of the first portions includes an axial grip surface where the grip surfaces are aligned with the body in an orientation for gripping. The body includes a layer of an additive configured to form a barrier that prevents or reduces the ability of oxygen and/or light to move from an environment surrounding the container to an interior space of the container.

BRIEF DESCRIPTION OF THE DRAWINGS

The present disclosure will become more readily apparent from the specific description accompanied by the following drawings, in which.

DETAILED DESCRIPTION

Figure 1:
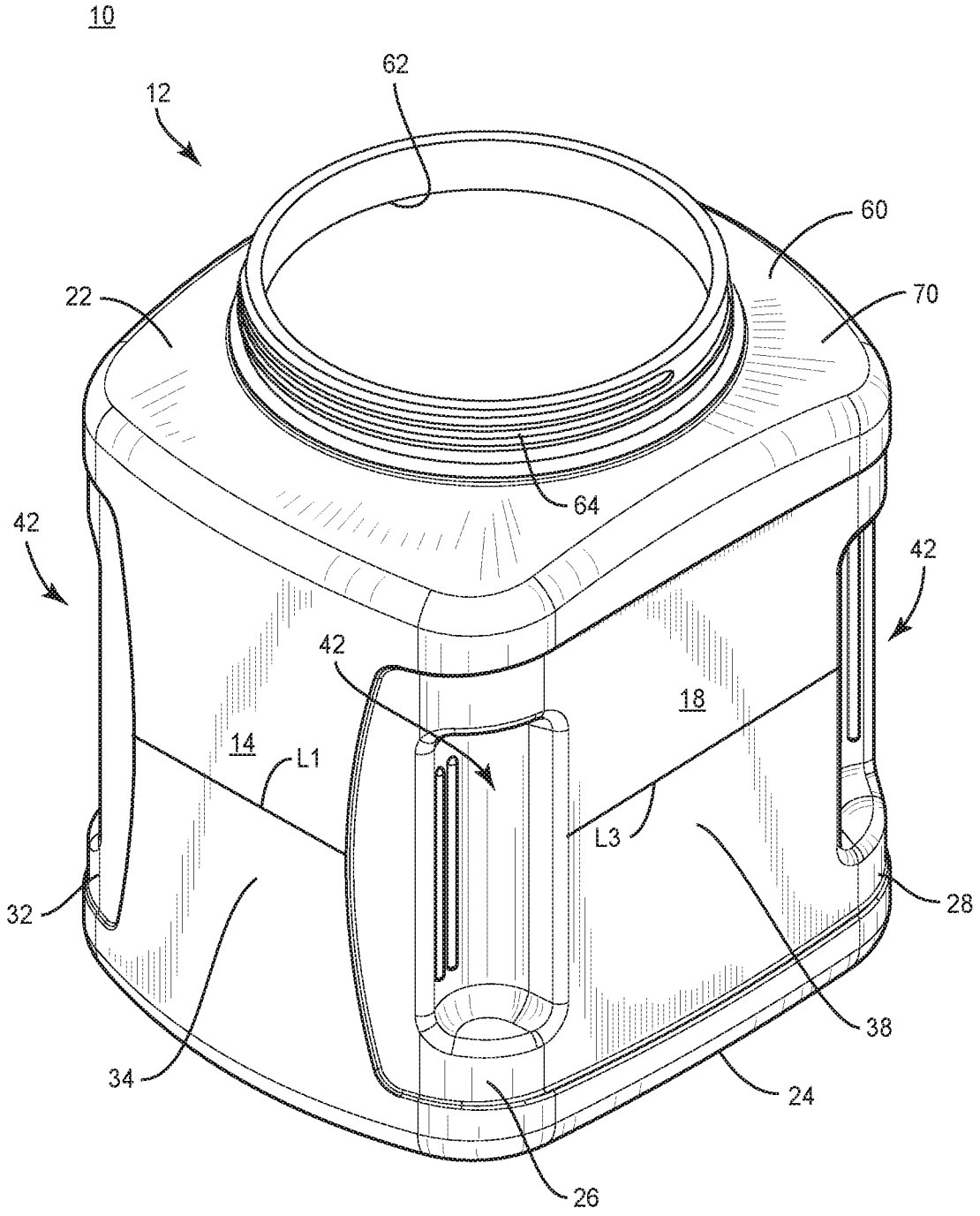
FIG. 1 is an isometric view of components of one embodiment of a food packaging container in accordance with the principles of the present disclosure.

The exemplary embodiments of a food packaging container are discussed in terms of containers and more particularly, in terms of a food packaging container, which can be used for containing food, food preparation and/or beverage products. In some embodiments, a food packaging container is provided that can be easily handled by users that have a limited grip strength and/or that have small hands. In some embodiments, the container has multiple grip configurations and can be utilized from either side of the container or by using a grip surface on the container. In some embodiments, the container includes a large opening or wide mouth that allows the container to be filled and evacuated quickly. In some embodiments, the large opening or wide mouth also facilitates a wide range of uses for the container. In some embodiments, the large opening or wide mouth of the container can have a diameter or finish of about 89 mm or larger.

In some embodiments, the container includes a barrier to light and/or oxygen for improved shelf life and product protection. In some embodiments, the container uses a barrier guard technology, such as a layer of an additive to form a barrier that prevents or reduces the ability of oxygen and/or light to move from the environment surrounding the container to an interior space of the container.

In some embodiments, the container is made from a poly(ethylene terephthalate) (PET) resin material. In some embodiments, the container is rectangular with equal, opposing grips on narrow sides of the container. In some embodiments, the container includes equal sized label panels on the long sides of the container between the grips.

In some embodiments, the present disclosure includes a container wherein a barrier material is located in a discrete layer of a first part of a preform that is used to make the container, while the discrete layer of barrier material is not present in a second part of the preform. In some embodiments, the discrete layer may include other materials in addition to the barrier material, such as, for example, PET. In some embodiments, the second part of the preform forms dome or moil scrap that is trimmed from the first part. In some embodiments, the first part forms a majority of the finished container, while the second part portion forms only a small percentage of the finished container. In some embodiments, a majority of the second part is trimmed from the first part so that most of the second part may be used as scrap. In some embodiments, the entire second part is trimmed from the first part such that the entire second part may be used as scrap. In some embodiments, the scrap is used to make other containers since the second part does not include any additives, for example, the section of the second part that is trimmed off remains suitable for use in making additional containers. Providing scrap material that is free of additives allows for full utilization of the scrap material and avoids processing issues associated with reprocessing scrap material that normally would contain additives and barrier materials.

In some embodiments, when the container is manufactured, scrap material produced in manufacturing the container is free of material additives, such as, for example, passive oxygen scavengers, active oxygen scavengers, colorants, calcium carbonate fillers and foaming agents. In some embodiments, the additives include one or more catalyst. In some embodiments, these additives provide particular functions in a PET bottle or container. In some embodiments, the scrap material produced in manufacturing the container is a dome or moil scrap that is trimmed from an intermediate article used to form the finished container. In some embodiments, in blow and trim applications where a part of the blown container is removed from the final bottles (dome, moil, etc.) it is desirable to not have these additives in the portion that is being removed. In some embodiments, many of these additives are expensive and it is desirable not to add extra cost into sections of the bottle that will not be used in the marketplace. These additives can cause considerable reuse issues in the grinding, drying and extrusion processes of the dome and moil.

In some embodiments, the present disclosure employs a two-phase injection system. In a one phase of the two-phase injection system, PET or virgin PET is injected into a preform. In another phase of the two-phase injection system, the preform comprises multiple layers, at least one of the multiple layers including an additive. In some embodiments, PET or virgin PET and one or more selected additives are injected into the preform in a second injection cycle to form the multiple layers. In some embodiments, the phase in which the multiple layers are produced begins after the first phase is completed. This allows a dome or moil section of the blown bottle that is trimmed from a finished container and is ground, blended, dried and added to the virgin PET melt stream to be free of additives when the scrap is reused. In some embodiments, the term "virgin PET" refers to a material that consists solely of PET and does not include any additives, such as, for example, the additives discussed above.

In some embodiments, the present disclosure may be useful for manufacturers that run multiple sizes of blow and trim bottles for various end uses. For example, the present disclosure may be useful to produce containers for food items, such as, for example, dressings, sauces and peanuts, wherein oxygen permeation through the sides of the container negatively affect shelf life and/or product flavor. It is envisioned that the present disclosure may be useful to produce containers for food items, such as, for example, non-dairy coffee creamers that require color pigment for both fill-line concealment and product protection against UV light penetration. Other containers that can be made from the disclosed process include containers for mayonnaise, salad dressings, peanuts as well as other condiments and/or food products.

The present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. Also, in some embodiments, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of components of a food packaging container. Alternate embodiments are also disclosed. Reference is made in detail to the exemplary embodiments of the present disclosure, which are illustrated in the accompanying figures. Turning to FIGS. 1-6, there are illustrated components of food packaging container 10.

Figure 3:
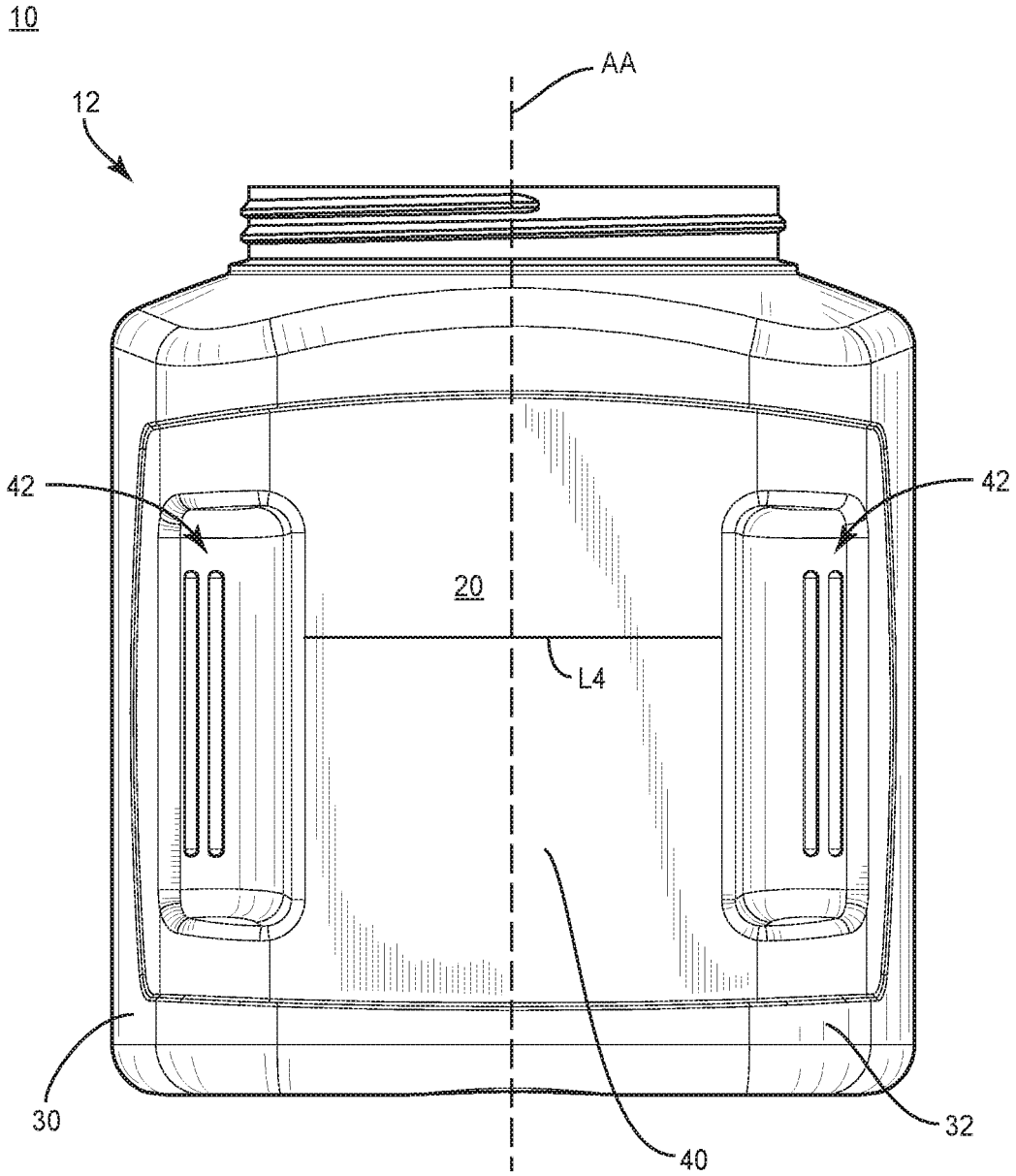
FIG. 3 is a side view of the food packaging container of FIG. 1.

Container 10 is configured for storing products such as food, food preparation and/or beverages. Container 10 includes a molded body 12 that defines a longitudinal axis AA, as shown in FIG. 3. Body 12 includes a rectangular configuration. In some embodiments, body 12 may include various configurations, such as, for example, oval, oblong triangular, square, polygonal, irregular, uniform, non-uniform, offset, staggered, and/or tapered. In some embodiments, body 12 may be manufactured by injection blow molding techniques, as described herein.

Body 12 includes a plurality of sides, such as, for example, a side 14, a side 16, a side 18 and a side 20. Sides 14, 16, 18 and 20 each extend from a top 22 to a bottom 24 of body 12. Sides 14, 16, 18 and 20 have a rectangular configuration. In some embodiments, sides 14, 16, 18 and 20 may include various configurations, such as, for example, oval, oblong triangular, square, polygonal, irregular, uniform, non-uniform, offset, staggered, and/or tapered.

Sides 14, 16 have equal lengths L1, L2 respectively and sides 18, 20 have equal lengths L3, L4 respectively. Lengths L1, L2 are less than lengths L3, L4 to facilitate gripping of container 10 by a user with smaller hands and/or limited gripping strength. In some embodiments, lengths L1, L2 are from about 2 to about 7.5 inches. In some embodiments, lengths L3, L4 are from about 3 inches to about 8 inches.

Side 14 and side 16 each include a planar configuration and are disposed opposite one another such that side 14 and side 16 are relatively parallel. In some embodiments, side 14 may extend at alternate configurations relative to side 16, such as, for example, arcuate, offset, staggered, transverse, angular and/or undulating. Side 18 and side 20 each include a planar configuration and are disposed opposite one another such that side 18 and side 20 are relatively parallel. In some embodiments, side 18 may extend at alternate configurations relative to side 20, such as, for example, arcuate, offset, staggered, transverse, angular and/or undulating.

Figure 5:
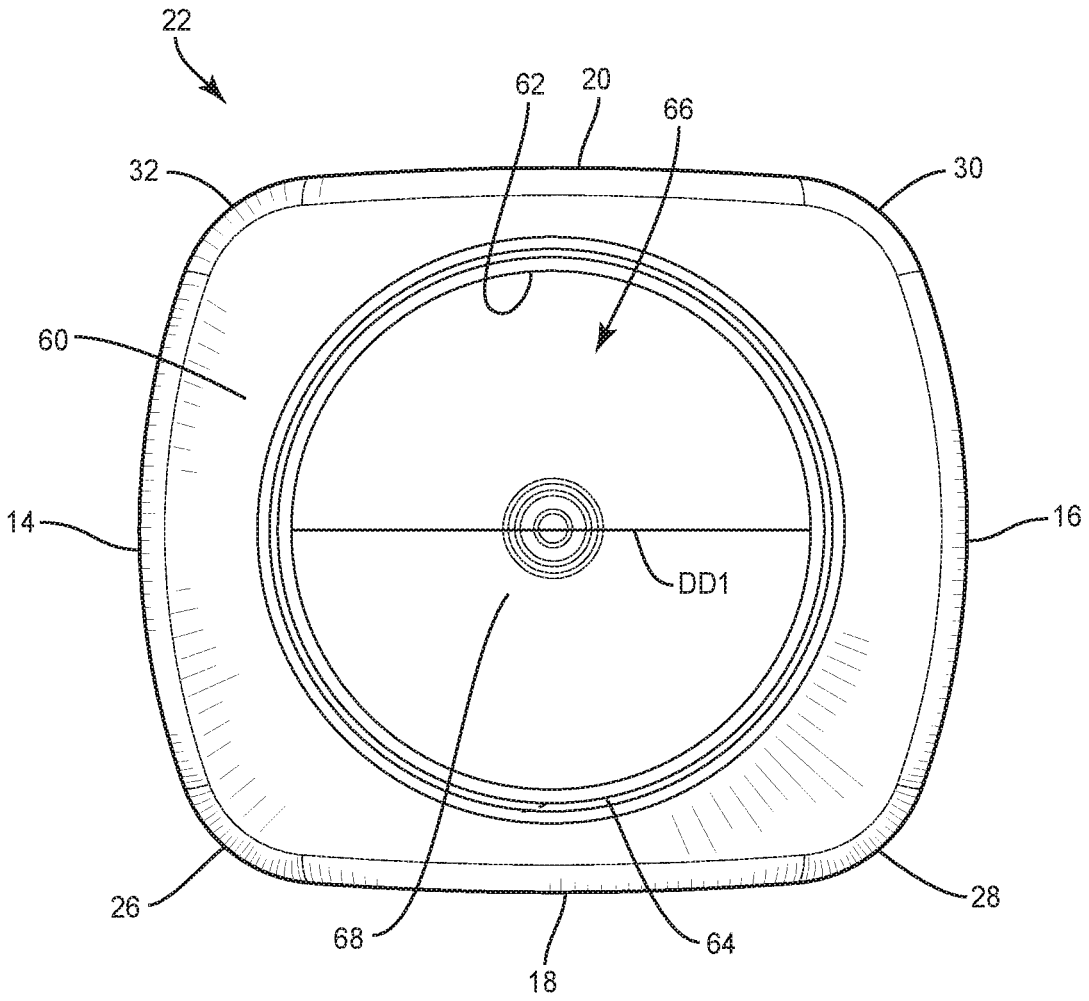
FIG. 5 is a top view of the food packaging container of FIG. 1.
Figure 6:
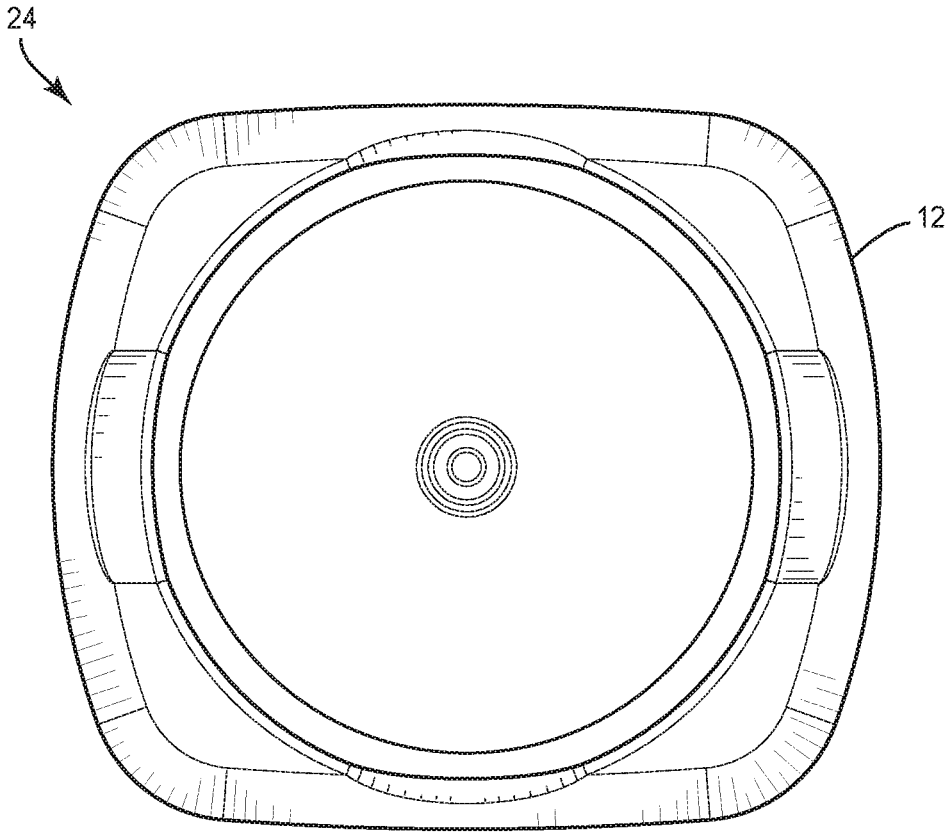
FIG. 6 is a bottom view of the food packaging container of FIG. 1.

Body 12 includes axial corners, such as, for example, corners 26, 28, 30 and 32, as shown in FIG. 5. An intersection of side 14 and side 18 forms corner 26. An intersection of side 18 and side 16 forms corner 28. An intersection of side 16 and side 20 forms corner 30. An intersection of side 20 and side 14 forms corner 32. Corners 26, 28, 30 and 32 extend axially from top 22 to bottom 24. In some embodiments, body 12 includes one or a plurality of axial corners. Corners 26, 28, 30, 32 include a curved configuration such that corners 26, 28, 30, 32 include rounded edges.

Figure 2:
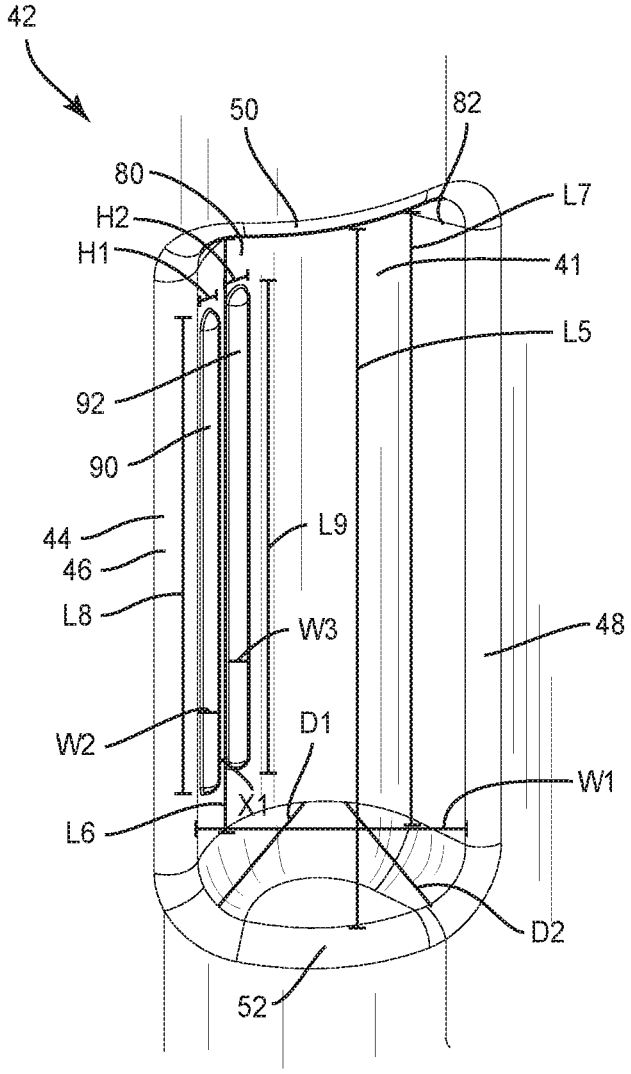
FIG. 2 is an enlarged break away view of components of the food packaging container of FIG. 1.

Each corner 26, 28, 30, 32 includes a surface 41 that defines a recess 42, as shown in FIG. 2. Recesses 42 facilitate gripping of container 10 by a user that has limited grip strength and/or a user having small hands. Each recess 42 extends axially along corners 26, 28, 30, 32 such that recesses 42 are relatively parallel. Each recess 42 has a length L5 and a width W1. In some embodiments, length L5 is from about 10 millimeters (mm) to about 100 mm. In some embodiments, width W1 is from about 5 millimeters (mm) to about 50 mm. In some embodiments, each recess 42 may include various lengths and/or widths.

Recess 42 includes a border 44. Border 44 includes sides 46, 48, 50 and 52 that have a curved configuration such that sides 46, 48, 50, 52 are rounded. Sides 46, 48, 50, 52 are disposed in a substantially perpendicular relative orientation forming a substantially rectangular configuration. In some embodiments, border 44 may include various configurations, such as, for example, oval, oblong triangular, square, polygonal, irregular, uniform, non-uniform, offset, staggered, and/or tapered. In some embodiments, body 12 can include one or a plurality of recesses 42. In some embodiments, recess 42 can be alternatively disposed within sides 14, 16, 18 and/or 20.

Each recess 42 includes a portion 80 and a portion 82, as shown in FIG. 2. Portion 80 merges with portion 82 to form a concave configuration of recess 42. In some embodiments, portion 80 is disposed at a selected angle relative to portion 82 to facilitate gripping container 10. In some embodiments, portion 80 may extend at alternate configurations relative to portion 82, such as, for example, perpendicular, offset, staggered, transverse and/or undulating. Portion 80 includes a length L6 and a depth D1. Portion 82 includes a length L7 and a depth D2. Length L6 is equal to length L7 and depth D1 is equal to depth D2 such that portions 80, 82 are configured substantially similar. In some embodiments, portion 80 and/or portion 82 can be can be smooth, rough, textured, porous, semi-porous, dimpled, knurled, toothed, raised, grooved and/or polished to facilitate gripping. In some embodiments, portion 80 and/or portion 82 can be textured via a rubber surface.

Figure 4:
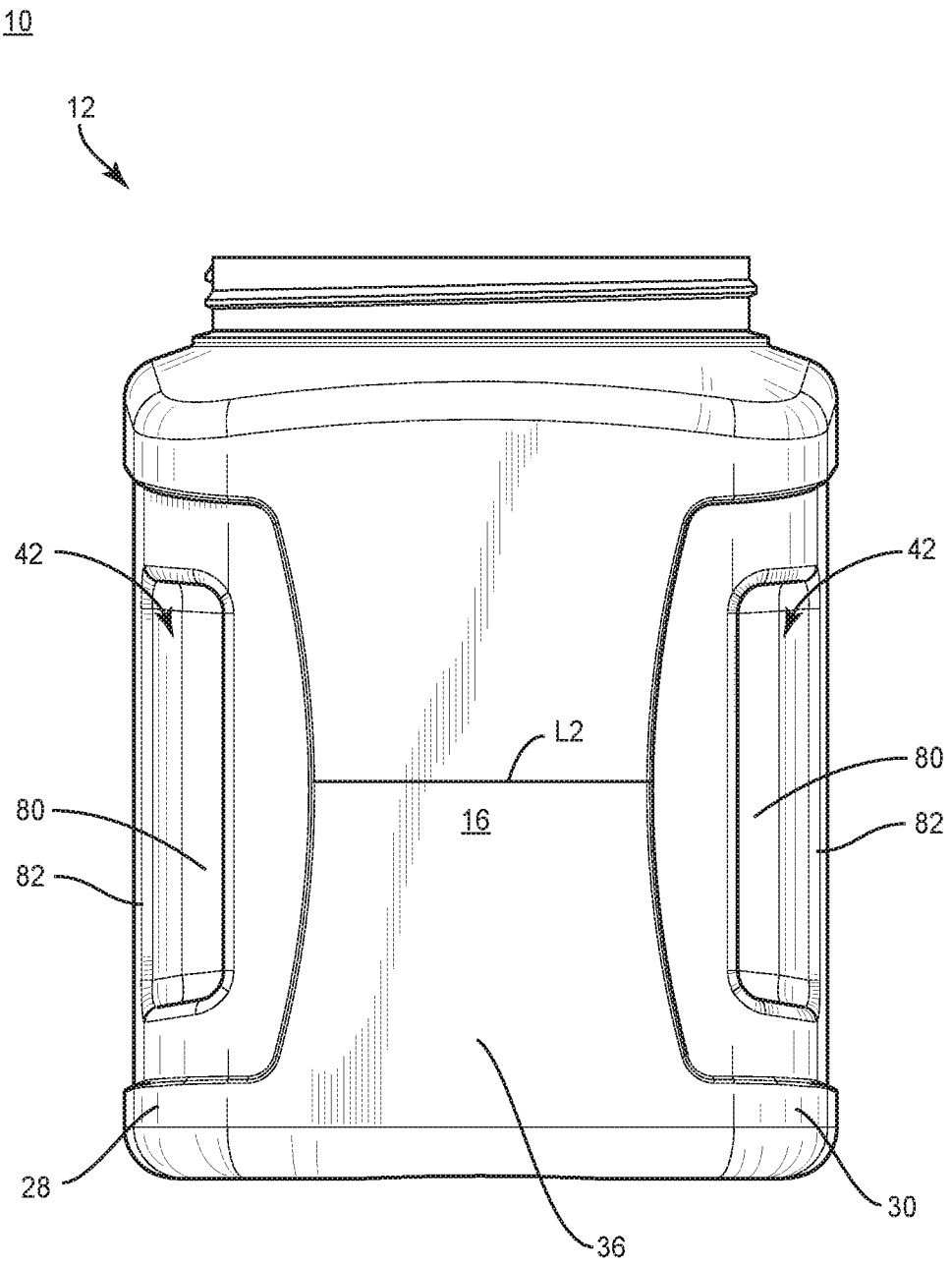
FIG. 4 is a side view of the food packaging container of FIG. 1.

Each portion 80 includes an axial grip surface, such as, for example, ribs 90, 92. Ribs 90, 92 are aligned with body 12 in an orientation for gripping, as shown in FIG. 4. For example, ribs 90, 92 are disposed in relative parallel alignment such that container 10 can be gripped at corner 28 and corner 30 by hands of a user. Ribs 90, 92 facilitate gripping of container 10 for carrying and/or pouring products disposed within container 10.

Rib 90 includes an entirely linear configuration and includes a raised surface having a height H1, as shown in FIG. 2. Rib 90 extends along all or a portion of portion 80. Rib 90 includes a length L8 and a width W2. In some embodiments, length L8 is from about 5 to about 80 mm. In some embodiments, width W2 is from about 1 to about 10 mm.

Rib 92 is disposed spaced apart from rib 90 and distance X1. Rib 92 includes an entirely linear configuration and includes a raised surface having a height H2. Rib 92 extends along all or a portion of portion 80. Rib 92 includes a length L9 and a width W3. In some embodiments, length L9 is from about 5 to about 80 mm. In some embodiments, width W3 is from about 1 to about 10 mm. In some embodiments, portion 80 includes one or a plurality of ribs.

In some embodiments, ribs 90, 92 can be smooth, textured, porous, semi-porous, dimpled, knurled, toothed, grooved and/or polished. In some embodiments, ribs 90, 92 can be textured such as, for example, roughened to increase grip. In some embodiments, ribs 90, 92 can be arcuate, dashed, uniform, non-uniform and/or wavy. In some embodiments, a portion of ribs 90, 92 can be angled, such as, for example, at an edge(s) or end(s). In some embodiments, ribs 90, 92 can alternatively be dots, squares, nipples, and/or crescent moon shaped. In some embodiments, ribs 90, 92 may be alternatively disposed on body 12 to facilitate gripping.

In some embodiments, ribs 90, 92 are monolithic with portion 80 and are made from the same material. In some embodiments, ribs 90, 92 are separately applied and/or adhered to portion 80. In some embodiments, ribs 90, 92 are made from a different material. In some embodiments, ribs 90, 92 are made from a material such as, for example, rubber.

Side 14 comprises a panel 34 and side 16 comprises a panel 36, as shown in FIGS. 1 and 4. Side 18 comprises a panel 38 and side 20 comprises a panel 40, as shown in FIGS. 1 and 3. In some embodiments, panels 34, 36, 38 and/or 40 are uniform and/or continuous.

In some embodiments, panels 34, 36, 38 and/or 40 are configured for disposal with indicia (not shown). In some embodiments, the indicia includes markings that may be disposed in increments of measurement. In some embodiments, the indicia may include human readable visual indicia, such as, for example, a label, color coding, alphanumeric characters or an icon. In some embodiments, the indicia may be a printed or written item in combination with a slot or groove, whereby the printed or written item is placed in the slot or groove to display information. In some embodiments, the indicia may be applied as an adhesive. In some embodiments, when the indicia is a label, the label can indicate the brand and/or can identify the product that is being stored in container 10. In some embodiments, a label can engage with panels 34, 36, 38 and/or 40 via an adhesive.

Top 22 of body 12 includes a surface 60 that defines a wide mouth opening 62 configured for facilitating filling of container 10. Opening 62 is centrally disposed relative to top 22. Opening 62 includes a threaded neck 64. In some embodiments, threaded neck 64 is configured for threaded engagement with a cap (not shown) to seal container 10. Opening 62 has a diameter DD1 from about 89 mm to about 120 mm, as shown in FIG. 5.

Sides 14, 16, 18 and 20 define a cavity 66 having an interior space 68. Interior space 68 is configured to hold and store products such as food, food preparation and/or beverages and these products are inserted into container 10 via opening 62.

A layer 70 of an additive is added to container 10 and is configured to form a barrier that prevents or reduces the ability of oxygen and/or light to move from an environment surrounding container 10 to interior space 68 of container 10. Layer 70 increases the shelf life of the product disposed within container 10 for up to 1 to about 3 years.

In some embodiments, layer 70 comprises an oxygen scavenger and/or oxygen barrier material in an amount from 0.1 wt. % to about 20.0 wt. % of container 10. In some embodiments, layer 70 comprises an oxygen scavenger and/or oxygen barrier material in an amount from 0.1, 0.2, 0.3, 0.4, 0.5, 0.6, 0.7, 0.8, 0.9, 1.0, 2.0, 3.0, 4.0, 5.0, 6.0, 7.0, 8.0, 9.0, 10.0, 11.0, 12.0, 13.0, 14.0, 15.0, 16.0, 17.0, 18.0, 19.0 to about 20.0 wt. % of container 10.

Layer 70 of container 10 is not removed during the manufacturing process such that the oxygen scavenger and/or oxygen barrier material is present in finished container 10. In some embodiments, container 10 may comprise one or more layers of an additive having an oxygen scavenger and/or barrier material.

In some embodiments, the oxygen barrier is a passive barrier and is unreactive with oxygen. In some embodiments, the oxygen barrier is an oxygen scavenger and is reactive with oxygen to capture the oxygen. In some embodiments, the oxygen scavenger includes one or more oxygen barriers, such as, for example, one or more polymers, metals, compatibilizers, catalysts, and/or fatty acid salts.

Container 10 is about 114 ounces in size. In some embodiments, container 10 can be any size and in some embodiments, is from about 90 to about 130 ounces in size.

In some embodiments, container 10 includes PET resin enhancements via improved material orientation with selective physical performance features, such as, for example, improved top load performance, improved vacuum resistance performance and/or hoop strength, improved oxygen performance, improved moisture vapor transmission rate (MVTR) performance. In some embodiments, the enhancements include modifications to the manufacturing process or the addition of additives to provide a container 10 made of PET resin that has a selected crystallinity, as discussed herein.

In some embodiments, container 10 has a crystallinity of about 10%. In some embodiments, container 10 has a crystallinity between about 15% and about 20%. In some embodiments, a preform of container 10 can be heated and stretched to produce a container 10 having a crystallinity between about 10 and about 50%. In some embodiments, the preform of container 10 includes a molecular weight between about 120,000 g/mol and about 500,000 g/mol.

In some embodiments, container 10 is made from a material comprising semi-crystalline or crystalline poly(ethylene terephthalate) (PET) resin. In some embodiments, container 10 may be fabricated from plastic and formed using injection and compression blow molding processes. In some embodiments, container may be fabricated from polyester (PES), polyethylene (PE), high-density polyethylene (HDPE), polyvinyl chloride (PVC), polyvinylidene chloride (PVDC) (Saran), low-density polyethylene (LDPE), polypropylene (PP), polystyrene (PS), high impact polystyrene (HIPS), polyamides (PA) (Nylons), acrylonitrile butadiene styrene (ABS), polyethylene/acrylonitrile butadiene styrene (PE/ABS), polycarbonate (PC), polycarbonate/acrylonitrile butadiene styrene (PC/ABS), and/or polyurethanes (PU).

In some embodiments, a manufacturing method is provided for container 10. The method includes the steps of employing a single stage blow molding process and providing a preform that produces containers having recess 42 and ribs 90, 92. In some embodiments, the method includes injection blow molding the preform using a two-phase injection system, wherein one phase of the two-phase injection system (e.g., a first phase) comprises injecting material into the preform and another phase of the two-phase injection system (e.g., a second phase) comprises injecting material into the preform to form layer 70 or multiple layers, which at least includes an additive. The material used in the first phase does not include any additives. In some embodiments, the material used in the first phase is virgin PET without additives and the material used in the second phase is PET and additives. This allows the material that is used in the first phase to be reground as virgin PET so as to avoid regrinding issues discussed above.

In some embodiments, the method includes the step of testing the one or more preforms to ensure the one or more preforms include a selected weight and selected neck finish dimension. In some embodiments, the method includes the step of employing the one or more preforms with a recess 42 production mold. In some embodiments, the method includes the step of blow molding the one or more preforms, which may comprise a container. In some embodiments, the method includes the step of trimming the one or more blow-molded preforms. In some embodiments, the step of trimming includes a spin trim operation to remove a dome from the one or more blow-molded preforms. In some embodiments, the method includes a two-stage blow molding process such that the one or more preforms are injection molded and stored before blowing the one or more preforms to produce a container. In some embodiments, the method includes reusing the dome to produce other containers, such as, for example other wide mouth containers. In some embodiments, reusing the dome includes grinding, blending, drying and adding the dome and adding the ground, blended and dried material to a melt stream, wherein the done does not contain additives.

In some embodiments, ribs 90, 92 are blow molded with recess 42. In some embodiments, ribs 90, 92 are manufactured and separately attached, applied and/or adhered to portion 80 of recess 42.

In some embodiments, the present container is manufactured to include an oxygen scavenger and/or oxygen barrier material. That is, at least one layer of a portion of the container that is not removed during the manufacturing process includes an oxygen scavenger and/or oxygen barrier material such that the oxygen scavenger and/or oxygen barrier material is present in the finished container. In some embodiments, the container comprises one or more layers having an oxygen barrier material. In some embodiments, the oxygen barrier material is present in the container in an amount between about 0.1 wt. % and about 20 wt. % of the container. In some embodiments, the oxygen barrier material is present in the container in an amount about 3.0 wt. % of the container. In some embodiments, the oxygen barrier is a passive barrier and is unreactive with oxygen. In some embodiments, the oxygen barrier is an oxygen scavenger and is reactive with oxygen to capture the oxygen. In some embodiments, the oxygen scavenger includes one or more oxygen barrier, such as, for example, one or more polymers, metals, compatibilizers, catalysts, and/or fatty acid salts.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A food packaging container comprising:

a blow molded body defining a longitudinal axis, and including a plurality of sides and a plurality of axial corners, the corners each having a recess, the recesses each being divided into equally sized first and second halves, the corners each including a first portion and a second portion positioned in its recesses such that the portions each extend outwardly from a surface of the body that defines a respective one of the recesses, the first and second portions of a respective one of the recesses each being positioned entirely in one of the first and second halves of the respective one of the recesses, each of the first portions and the second portions including an axial grip surface, the grip surfaces being aligned with the body in an orientation for gripping, wherein the grip surfaces are disposed in relative parallel alignment such that the container can be gripped at a first corner and a second corner of a first side and can be gripped at a third corner and a fourth corner of a second side.

2. The container recited in claim 1, wherein each grip surface defines a rib, each rib having an entirely linear configuration.

3. The container recited in claim 2, wherein the ribs are spaced apart and raised.

4. The container recited in claim 1, wherein each first portion is disposed at a selected angle relative to each second portion.

5. The container recited in claim 1, wherein the recess is enclosed by a border, the border comprising four sides that form a rectangular configuration.

6. The container recited in claim 1, wherein the plurality of sides include a first side, a second side, a third side and a fourth side.

7. The container recited in claim 1, wherein the plurality of sides have a rectangular configuration.

8. The container recited in claim 1, wherein the container comprises a neck defining a wide mouth opening.

9. The container recited in claim 1, wherein the container comprises a layer of an additive configured to form a barrier that prevents or reduces the ability of oxygen and/or light to move from an environment surrounding the container to an interior space of the container.

10. A food packaging container comprising:

a blow molded body defining a longitudinal axis and including a first side and a second side, at least one of the sides including a first axial corner and a second axial corner, each corner having a recess, the recesses each being divided into equally sized first and second halves, the corners each including a first portion and a second portion positioned in its recess such that the portions each extend outwardly from a surface of the body that defines its recess, the first and second portions of a respective one of the recesses each being positioned entirely in one of the first and second halves of the respective one of the recesses, each of the first portions and the second portions including an axial grip surface having a linear configuration, the grip surfaces being aligned with the body in an orientation for gripping, wherein the grip surfaces are disposed in relative parallel alignment such that the container can be gripped at a third corner and a fourth corner of the second side.

11. The container recited in claim 10, wherein the grip surfaces are disposed in relative parallel alignment such that the container can be gripped at the first corner and the second corner of the first side.

12. The container recited in claim 10, wherein each grip surface defines a rib, the ribs being spaced apart and raised.

13. The container recited in claim 10, wherein the recess is enclosed by a border, the border comprising four sides.

14. The container recited in claim 10, wherein the body comprises a third side and a fourth side, the container comprising a neck extending proximally from the proximal wall, the neck defining a wide mouth opening.

15. The container recited in claim 10, wherein the container comprises a layer of an additive configured to form a barrier that prevents or reduces the ability of oxygen and/or light to move from an environment surrounding the container to an interior space of the container.

16. A food packaging container comprising:

a blow molded body defining a longitudinal axis, and including a plurality of sides and a plurality of axial corners, each corner having a recess, the recesses each being divided into equally sized first and second halves, the body including a first portion and a second portion positioned in one of the recesses such that the portions each extend outwardly from a surface of the body that defines a respective one of the recesses, the first and second portions each being positioned entirely in one of the first and second halves of one of the recesses, each of the first portion and the second portion including an axial grip surface, the grip surfaces being aligned with the body in an orientation for gripping, and a layer of an additive configured to form a barrier that prevents or reduces the ability of oxygen and/or light to move from an environment surrounding the container to an interior space of the container, wherein the grip surfaces are disposed in relative parallel alignment such that the container can be gripped at a first corner and a second corner of a first side, and such that the container can be gripped at a third corner and a fourth corner of a second side.

17. The container recited in claim 1, wherein the portions each extend parallel to the longitudinal axis.

18. The container recited in claim 1, wherein the portions each have an equal length along the longitudinal axis.

19. The container recited in claim 1, wherein the portions each have an equal width in a direction that is perpendicular to the longitudinal axis.

20. The container recited in claim 1, wherein the container is made from poly(ethylene terephthalate).

* * * * *